US010344726B2

(12) United States Patent
Yoshimura et al.

(10) Patent No.: US 10,344,726 B2
(45) Date of Patent: Jul. 9, 2019

(54) FUEL INJECTION VALVE

(71) Applicant: Hitachi Automotive Systems, Ltd., Hitachinaka-shi, Ibaraki (JP)

(72) Inventors: Kazuki Yoshimura, Tokyo (JP); Mitsuhiro Matsuzawa, Tokyo (JP); Eiji Ishii, Tokyo (JP); Akihiro Yamazaki, Hitachinaka (JP); Takahiro Saito, Hitachinaka (JP); Nobuaki Kobayashi, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 16 days.

(21) Appl. No.: 15/535,856

(22) PCT Filed: Sep. 14, 2015

(86) PCT No.: PCT/JP2015/075990
§ 371 (c)(1),
(2) Date: Jun. 14, 2017

(87) PCT Pub. No.: WO2016/143166
PCT Pub. Date: Sep. 15, 2016

(65) Prior Publication Data

US 2017/0335814 A1 Nov. 23, 2017

(30) Foreign Application Priority Data

Mar. 11, 2015 (JP) ..... 2015-047786

(51) Int. Cl.
*F02M 61/18* (2006.01)
*F02M 51/06* (2006.01)

(52) U.S. Cl.
CPC .... *F02M 61/1806* (2013.01); *F02M 61/1813* (2013.01); *F02M 61/1846* (2013.01); *F02M 51/0682* (2013.01)

(58) Field of Classification Search
CPC ..... F02M 61/1806; F02M 61/1813; F02M 61/1846; F02M 51/0682; F02M 61/1853; F02M 61/1833; F02M 61/162
(Continued)

(56) References Cited

U.S. PATENT DOCUMENTS

2001/0017325 A1 8/2001 Harata et al.
2002/0053610 A1 5/2002 Takagi et al.
(Continued)

FOREIGN PATENT DOCUMENTS

CN 104736835 A 6/2015
JP 2000-145590 A 5/2000
(Continued)

OTHER PUBLICATIONS

International Search Report (PCT/ISA/210) issued in PCT Application No. PCT/JP2015/075990 dated Dec. 15, 2015 with English translation (five (5) pages).
(Continued)

*Primary Examiner* — Arthur O. Hall
*Assistant Examiner* — Jaun C Barrera
(74) *Attorney, Agent, or Firm* — Crowell & Moring LLP

(57) ABSTRACT

The purpose of the present invention is to provide a fuel injection valve that can achieve sufficient atomization even if the spray angle is narrow. The present invention is a fuel injection valve, in which fuel flowing in from a fuel passage section 5*c* is made to flow so as to diffuse from the center of a fuel diffusion chamber 6B toward the outer circumference and to flow into a nozzle hole 7, wherein: the nozzle hole 7 comprises a first nozzle hole 7*b*, and a second nozzle hole 7*d* and a third nozzle hole 7*a* that neighbor the first nozzle hole 7*b* and are separated therefrom in the circumferential direction of the fuel diffusion chamber 6B; and, if the distance L4 between the center of the entry-side opening of the first
(Continued)

nozzle hole 7*b* and the center of the entry-side opening of the second nozzle hole 7*d* is greater than the adistance L1 between the center of the entry-side opening of the first nozzle hole 7*b* and the center of the entry-side opening of the third nozzle hole 7*a*, the exit-side opening of the first nozzle hole 7*b* is disposed on the inside of an arrangement circle 101 and on the second nozzle hole 7*d* side of a line segment 107.

2 Claims, 9 Drawing Sheets

(58) Field of Classification Search
USPC ..... 239/585.1, 584–585.5, 533.1–533.15
See application file for complete search history.

(56) References Cited

U.S. PATENT DOCUMENTS

| | | | | |
|---|---|---|---|---|
| 2008/0169367 | A1 | 7/2008 | Oomura et al. | |
| 2013/0104847 | A1* | 5/2013 | Ishii ..... | F02M 61/1813 123/445 |
| 2015/0136877 | A1 | 5/2015 | Sakata et al. | |
| 2015/0233333 | A1 | 8/2015 | Hashii | |

FOREIGN PATENT DOCUMENTS

| | | | |
|---|---|---|---|
| JP | 3130439 | B2 | 1/2001 |
| JP | 2001-317431 | A | 11/2001 |
| JP | 2005-307781 | A | 11/2005 |
| JP | 2007-182807 | A | 7/2007 |
| JP | 2008-169766 | A | 7/2008 |
| JP | 4209803 | B2 | 1/2009 |
| JP | 2009-228467 | A | 10/2009 |
| JP | 2010-151053 | A | 7/2010 |
| WO | WO 2014/024292 | A1 | 2/2014 |

OTHER PUBLICATIONS

Japanese-language Written Opinion (PCT/ISA/237) issued in PCT Application No. PCT/JP2015/075990 dated Dec. 15, 2015 (three (3) pages).

Chinese-language Office Action issued in counterpart Chinese Application No. 201580052282.2 dated Nov. 5, 2018 with English translation (14 pages).

* cited by examiner

FUEL INJECTION VALVE

TECHNICAL FIELD

The present invention relates to a fuel injection valve for use in an internal combustion engine such as a gasoline engine and, more particularly, to a fuel injection valve including a valve element and a valve seat, in which the valve element abuts against the valve seat to prevent leakage of fuel and leaves the valve seat to enable injection to be performed.

BACKGROUND ART

JP 2010-151053 A (PTL 1) discloses an invention of a fuel injection nozzle. The fuel injection nozzle achieves both atomization of fuel spray and controllability of an injection direction by having a flared nozzle hole formed to face outwardly on a downstream side and by allowing a relation between a distance x and a length L to satisfy $x/L<0.05$, where the distance x is between a portion of an upstream end face of the nozzle hole farthest from a central axis and a portion of a downstream end face of the nozzle hose nearest the central axis and the length L is a length of a wall surface of the nozzle hole on the central axis side.

JP 2001-317431 A (PTL 2) discloses an invention of a fluid injection nozzle. The fluid injection nozzle achieves atomization of fuel spray by having nozzle holes disposed to be spaced away from a central axis of a nozzle plate toward a fuel injection direction and thereby allowing fuel that flows in the nozzle hole to be guided along, and spreading over, an inner peripheral surface of the nozzle hole before being injected as a liquid film.

JP 2008-169766 A (PTL 3) discloses an invention of a fuel injection nozzle that has eighteen nozzle holes that are formed in a nozzle plate and divided into two groups. In the fuel injection nozzle, the two groups of nozzle holes form spray flows extending in two directions. The fuel injection nozzle forms spray flows such that intersection points between imaginary straight lines that represent passage axes of the respective nozzle holes extending in the fuel injection direction and an imaginary plane that is a predetermined distance away in the fuel injection direction from the nozzle hole plate and that is orthogonal to an injection axis of the nozzle hole plate are disposed at vertices of a regular octagon.

CITATION LIST

Patent Literature

PTL 1: JP 2010-151053 A
PTL 2: JP 2001-317431 A
PTL 3: JP 2008-169766 A

SUMMARY OF INVENTION

Technical Problem

A need exists in recent years for reduction in fuel consumption and in harmful exhaust gases of automotive engines. Atomization of fuel spray supplied to the automotive engines has thus become important. Furthermore, a spray atomization effect can no longer be obtained if injected fuel is deposited on an intake port wall surface. Controllability of a spray angle (spray spread) is thus important in order to reduce fuel deposition on the wall surface. For controllability of the spray angle, a need exists, in particular, for a fuel injection valve that achieves spraying involving a narrow spray angle.

PTL 1 discloses a method for promoting atomization, in which a flared nozzle hole is incorporated and flow separation is utilized, so that fuel injected from the fuel injection hole can be formed into a horseshoe-shaped jet. PTL 2 discloses a method for controlling the injection direction by setting an optimum dimension for the nozzle hole. PTL 3 discloses a method for reducing an uneven injection amount by setting inclination angles for a plurality of nozzle holes. In all of the methods disclosed in the above patent literature, however, the nozzle hole is inclined for spray atomization such that the central axis thereof is farther away from the central axis of the nozzle plate toward the downstream side, so that the spray spreads over an outer edge side of the nozzle plate in a direction in which each nozzle hole is inclined. Fuel that has flowed into the nozzle hole collides with the wall surface of the nozzle hole and a flow having a high-velocity component is induced in a plane perpendicular to the central axis of the nozzle hole. Atomization is promoted because a radial velocity component of the induced flow causes the fuel to tend more to spread in an area downstream of the nozzle hole. At this time, a greater collision force can be obtained from greater inclination angles of the nozzle hole with respect to the direction in which the fuel flows in. To narrow the spray angle, however, the inclination of the nozzle hole needs to be reduced. A reduced inclination of the nozzle hole unfortunately reduces the collision force, resulting in aggravated particle diameters.

An object of the invention is to provide a fuel injection valve that can achieve sufficient atomization even with a narrow spray angle.

Solution to Problem

In order to achieve the above object, the present invention provides a fuel injection valve including: a seat member having a valve seat; a valve element that seats on the valve seat to be closed and leaves the valve seat to be open; a fuel passage portion disposed downstream of the valve seat; a fuel diffusion chamber disposed downstream of the fuel passage portion; and a plurality of nozzle holes through which fuel in the fuel diffusion chamber is injected to an outside, the fuel injection valve causing fuel that has flowed from the fuel passage portion into the fuel diffusion chamber to be diffused from a central side toward an outer peripheral side to thereafter flow into the nozzle holes, wherein the nozzle holes include a first nozzle hole, and second and third nozzle holes disposed to be spaced apart from the first nozzle hole at least in a circumferential direction of the fuel diffusion chamber, the second and third nozzle holes being adjacent in the circumferential direction to the first nozzle hole, and when a distance between a center of an entry-side opening of the first nozzle hole and a center of an entry-side opening of the second nozzle hole is greater than a distance between the center of the entry-side opening of the first nozzle hole and a center of an entry-side opening of the third nozzle hole, the first nozzle hole has an inclination direction set such that an exit-side opening is disposed within a range including a tangent extending tangentially to an arrangement circle that is drawn about a center of the fuel diffusion chamber and that passes through the center of the entry-side opening, the range being disposed on a side of the center of the fuel diffusion chamber with respect to the tangent, and the range including a line segment that passes through the center of the fuel diffusion chamber and the center of the entry-side opening and that is disposed on a side of the second nozzle hole with respect to the line segment.

At this time, a fuel flow flowing from a central side of the fuel diffusion chamber toward the nozzle hole collides with an inclined surface of the nozzle hole and a flow having a large velocity component is induced in a plane perpendicular to a central axis of the nozzle hole. As a result, fuel tends more readily to spread in an area downstream of the exit of the nozzle hole, so that atomization is promoted.

Advantageous Effects of Invention

The aspect of the present invention can provide a fuel injection valve that narrows the spray angle to thereby reduce an amount of fuel sticking to an intake port wall surface, while promoting atomization, thereby achieving an internal combustion engine that can offer enhanced exhaust performance.

Problems, configurations, and effects other than those described above are made clear by the following description of embodiments.

DESCRIPTION OF EMBODIMENTS

Embodiments of the present invention will be described below.

First Embodiment

A fuel injection valve according to a first embodiment of the present invention will be described below with reference to FIGS. 1 to 8.

Figure 1:
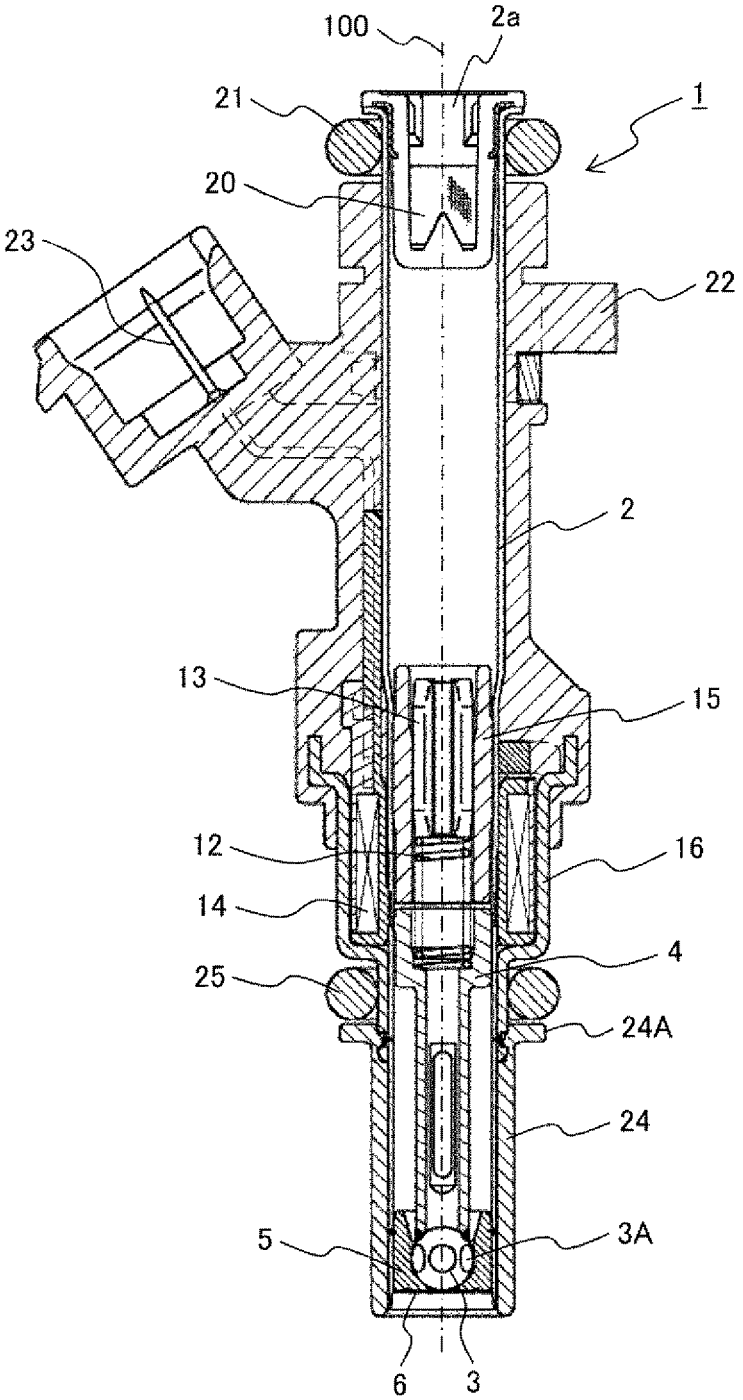
FIG. 1 is a cross-sectional view of a fuel injection valve according to an embodiment of the present invention.

A fuel injection valve 1 shown in FIG. 1 represents an exemplary fuel injection valve intended for a port-injection gasoline engine. Effects of the present invention are nonetheless valid in a fuel injection valve for a direct injection gasoline engine and a fuel injection valve driven by a piezo element or a magnetostrictor.

Description of Basic Operation of Injection Valve

FIG. 1 is a cross-sectional view of a fuel injection valve according to one embodiment of the present invention. Basic configurations of the fuel injection valve 1 shown in FIG. 1 are applied also to second to fourth embodiments to be described later. In the description that follows, a vertical direction is defined on the basis of FIG. 1. The vertical direction does not, however, mean a vertical direction under a condition in which the fuel injection valve 1 is mounted in an engine.

In FIG. 1, the fuel injection valve 1 supplies fuel to, for example, an internal combustion engine used as an automotive engine. A casing 2 is formed into a slender cylinder through, for example, pressworking or cutting. The casing 2 has a shouldered configuration integrating a thin-walled portion, a thick-walled portion, a small-diameter portion, and a large-diameter portion. The casing 2 is formed of a ferrite-based stainless steel to which a flexible material such as titanium has been added and exhibits a magnetic property. A fuel supply port 2*a* is disposed at a first end portion of the casing 2, while a nozzle body 5 is disposed at a second end portion of the casing 2. A nozzle plate 6 is fixedly attached to a lower end face (leading end face) of the nozzle body 5. The nozzle plate 6 has a plurality of through holes 7 (See FIGS. 2 and 3). The through holes 7 constitute fuel injection holes 7 (hereinafter referred to as nozzle holes) from which fuel is injected.

An electromagnetic coil 14 and a yoke 16 formed of a magnetic material surrounding the electromagnetic coil 14 are disposed on the outside of the casing 2. A core 15, an anchor 4, a valve element 3, the nozzle body 5, and the nozzle plate 6 are disposed inside the casing 2. The core 15, after having been inserted in the casing 2, is disposed inside the electromagnetic coil 14. The anchor 4 faces an end face of the core 15 on a leading end side (lower end face) across a gap. The anchor 4 is mounted so as to be movable in a direction of a central axis 100 of the fuel injection valve. The anchor 4 is manufactured using metal powder formed of a magnetic material and by subjecting the metal power to injection molding such as metal injection molding (MIM). The valve element 3 is a hollow member that is held by the anchor 4 and that extends in an axial direction. A spherical body portion 3A is disposed at a leading end portion of the valve element 3. The nozzle body 5 is disposed in a fixed condition at the casing 2 on the leading end side (lower end side) of the valve element 3. The nozzle body 5 has a pedestal (valve seat) which the spherical body portion 3A disposed at the leading end portion of the valve element 3 contacts or leaves. The nozzle plate 6 is disposed on the side of a leading end face of the nozzle body 5. The nozzle plate 6 has the nozzle holes 7 formed to extend in a thickness direction. The nozzle plate 6 has a surface in contact with nozzle body 5 joined through welding. The nozzle body 5 is joined to the casing 2 through welding.

In FIG. 1, a spring 12 as an elastic member is disposed inside the core 15. The spring 12 applies force (urging force)

that causes the leading end of the valve element 3 to be pressed against the nozzle body 5. A spring adjuster 13 is disposed in sequence at an upper end portion of the spring 12. The spring adjuster 13 adjusts the pressing force by the spring 12. A filter 20 is disposed at the fuel supply port 2*a*. The filter 20 removes foreign matter from fuel. Additionally, an O-ring 21 is fitted to an outer periphery of the fuel supply port 2*a*. The O-ring 21 seals fuel to be supplied.

A resin cover 22 is formed by, for example, resin molding so as to cover the casing 2 and the yoke 16. A connector 23 for supplying the electromagnetic coil 14 with electric power is integrally formed with the resin cover 22. A protector 24 is a tubular member that is disposed at the leading end portion of the fuel injection valve 1 and formed of, for example, a resin material. The protector 24 covers an outer periphery of the leading end portion of the casing 2. The protector 24 includes a protrusion 24A that protrudes outwardly in a radial direction. The protrusion 24A forms with the yoke 16 an annular groove in which an O-ring 25 is retained. The annular groove is disposed below the coil 14. The foregoing arrangements result in the O-ring 25 being fitted on an outer periphery on the leading end side of the casing 2. The O-ring 25 is disposed in a locked state between the yoke 16 and the protector 24. The O-ring 25 provides a seal between an intake pipe and the fuel injection valve 1 when, for example, the leading end side of the casing 2 is mounted on, for example, a mounting portion (not shown) disposed at the intake pipe of the internal combustion engine.

When the electromagnetic coil 14 is in a de-energized condition, the fuel injection valve 1 is urged by the pressing force of the spring 12, so that the leading end of the valve element 3 (spherical body portion 3A) tightly contacts the nozzle body 5. A gap, specifically, a fuel passage is not formed between the valve element 3 and the nozzle body 5 under the foregoing condition. Thus, fuel that has flowed in through the fuel supply port 2*a* stays inside the casing 2. Specifically, the valve element 3 is in a valve-closed state.

Application of a current as an injection pulse to the electromagnetic coil 14 causes a magnetic flux to flow through a magnetic circuit formed by the yoke 16, the core 15, and the anchor 4 that are formed of a magnetic material. Electromagnetic force generated between the anchor 4 and the core 15 by the magnetic flux causes the valve element 3 to move until an upper end face of the anchor 4 (the face opposed to the core 15) contacts the lower end face of the core 15. The movement of the valve element 3 toward the core 15 side forms a fuel passage between the valve element 3 and the nozzle body 5. Specifically, the valve element 3 is brought into a valve-open state. Fuel inside the casing 2 flows from an area around the valve element 3 (spherical body portion 3A) to a downstream side before being injected from the fuel injection holes 7. A fuel injection amount is controlled as follows. Specifically, the valve element 3 is moved in the axial direction to correspond to the injection pulse that is intermittently applied to the electromagnetic coil 14 and timing to switch between the valve-open state and the valve-closed state is thereby adjusted.

Figure 2:
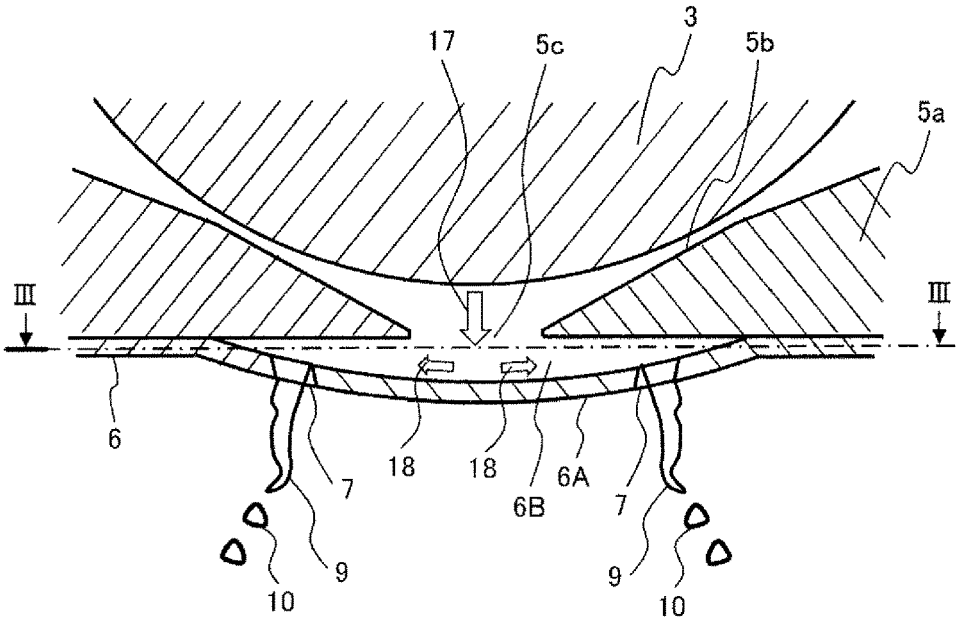
FIG. 2 is an enlarged cross-sectional view of parts near a leading end of a valve element of the fuel injection valve according to a first embodiment of the present invention.

FIG. 2 is an enlarged cross-sectional view of parts near the leading end of the valve element of the fuel injection valve according to the first embodiment of the present invention. Main parts involved in the present invention will be briefly described with reference to FIG. 2.

As shown in FIG. 2, the valve element 3 is a ball valve. A steel ball for ball bearings complying with the JIS standards, for example, is used as the ball (spherical body portion 3A). Advantageous points to lead to the adoption as the ball include: high circularity and mirror finish suitable for greater seating performance; and low cost thanks to mass production. For a configuration as a valve element, a ball having a diameter of about 3 to 4 mm is used because of a need for reduction in weight for a functional requirement as a movable valve.

In the nozzle body 5, an inclined surface including a seating position to be in tight contact with the valve element 3 has an angle of about 90° (80° to 100°). This inclination angle serves as an optimum angle for grinding areas near the seating position and achieving high circularity (enabling a grinding machine to be operated in best possible conditions), so that the above-described performance of seating with the valve element 3 can be maintained at a high level. It is noted that the nozzle body 5 having an inclined surface 5*b* including the seating position is subjected to quenching for higher hardness. Additionally, the nozzle body 5 is subjected to demagnetization by which unnecessary magnetization is removed. The foregoing configuration of the valve element enables injection amount control without fuel leakage. A valve element structure offering favorable cost performance can also be provided.

The nozzle plate 6 is extruded by a punch in a manufacturing process for forming a projecting surface 6A, so that the nozzle plate 6 is shaped into a lower protrusion. In the present embodiment, the projecting surface 6A has a curved surface portion that is shaped to protrude in a lower direction (outwardly of the fuel injection valve).

When the fuel injection valve 1 is in the valve-closed state, the valve element 3 abuts on a valve seat surface 5*b* formed of a conical surface on a seat member 5*a* to thereby seal the fuel. At this time, a contact portion on the side of the valve element 3 is formed of a spherical surface, so that contact between the valve seat surface 5*b* having the conical surface and the spherical surface is substantially a line contact. When the valve element 3 moves in an upper direction to produce a gap between the valve element 3 and the seat member 5*a*, fuel starts flowing through the gap and, from a direction of an arrow 17, collides with an upper surface of the nozzle plate 6 at an opening 5*c* in the seat member 5*a*. Thereafter, the fuel flows from a center of the nozzle plate 6 along the surface of the nozzle plate 6 as indicated by arrows 18. The fuel, after having flowed past the nozzle holes 7, forms a liquid film 9. The liquid film 9 is fragmented by instability caused by a capillary wave or shearing force with air into liquid droplets 10, so that atomization of fuel can be achieved.

The opening 5*c* constitutes a fuel passage portion (fuel introduction hole) through which fuel is introduced from a seat portion formed between the valve element 3 and the valve seat surface into a fuel chamber (fuel diffusion chamber) 6B formed inside the projecting surface 6A of the nozzle plate 6. The fuel chamber 6B allows the fuel that has flowed through the fuel passage portion 5*c* to flow into the nozzle holes 7 so as to be diffused from a central side toward an outer peripheral side.

Description of Detailed Shape and Effects

A detailed shape of the nozzle hole will be described below with reference to FIGS. 3 to 8.

Figure 3:
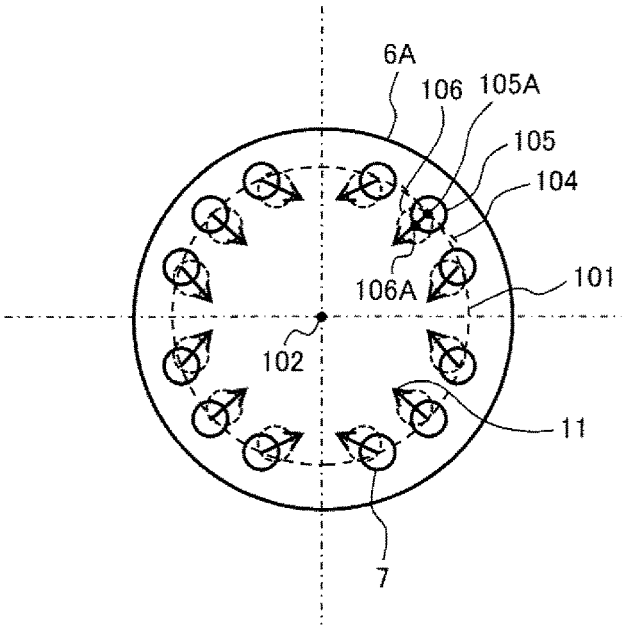
FIG. 3 is a view of a nozzle plate in the fuel injection valve according to the first embodiment of the present invention, as viewed from a valve element side.

FIG. 3 is a view of the nozzle plate in the fuel injection valve according to the first embodiment of the present invention, as viewed from the valve element side. FIG. 3 is a cross-sectional view taken along line in FIG. 2.

Arrows 11 indicate directions in which respective nozzle holes 7 are inclined. An arrangement circle 101 is a circle drawn about a central axis 102 of the nozzle plate 6 so as to pass a center 105A of an entry-side opening 105 of the nozzle holes 7. It is noted that, in the present embodiment, the central axis 102 of the nozzle plate 6 is aligned with the central axis 100 of the fuel injection valve. Additionally, the central axis 102 of the nozzle plate 6 passes through a center of the fuel diffusion chamber 6B.

In the present embodiment, each of the nozzle holes 7 is set to be inclined in a lower inward direction. Specifically, each of the nozzle holes 7 is set to be inclined such that the arrow 11 faces the inside of the arrangement circle 101. In this case, the direction in which each of the nozzle holes 7 is inclined is set such that, on a projection (FIG. 3) projected onto a plane perpendicular to the central axis 102, the arrow 11 is oriented toward a range that includes a tangent 104 drawn to extend on both sides of the center 105A of the entry-side opening 105 of the nozzle hole 7 and that is disposed on the side of the central axis 102 with respect to the tangent 104. Specifically, a center 106A of an exit-side opening 106 of the nozzle hole 7 is disposed in a range that includes the tangent 104 and that is disposed on the side of the central axis 102 with respect to the tangent 104. At this time, the center 106A of the exit-side opening 106 of the nozzle holes 7 is disposed at a position deviated from the center 105A of the entry-side opening 105.

Figure 4A:
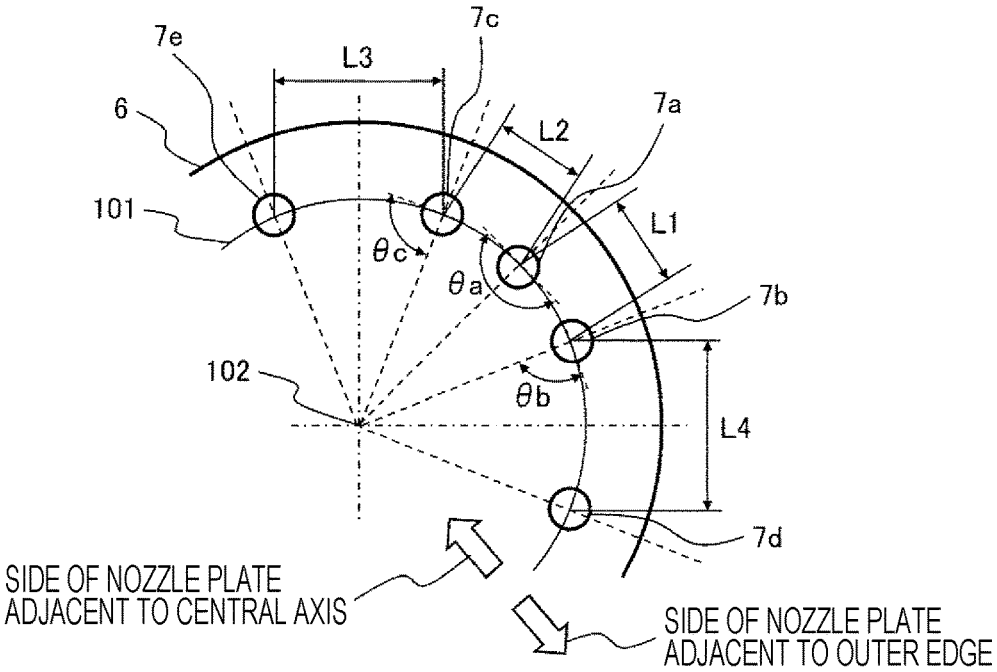
FIG. 4A is an explanatory view illustrating a direction in which nozzle holes disposed in the nozzle plate according to the first embodiment of the present invention are inclined.
Figure 4B:
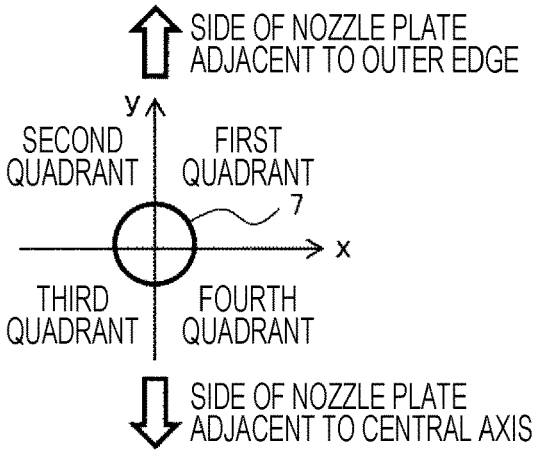
FIG. 4B is an explanatory view illustrating definitions of quadrants in any nozzle hole according to the first embodiment of the present invention.

The direction in which the nozzle hole 7 is inclined will be described in detail with reference to FIGS. 4A and 4B. FIG. 4A is an explanatory view illustrating the direction in which the nozzle holes disposed in the nozzle plate according to the first embodiment of the present invention are inclined. FIG. 4B is an explanatory view illustrating definitions of quadrants in any nozzle hole according to the first embodiment of the present invention. It is noted that FIG. 4A is an enlarged view of nozzle holes 7*a* to 7*e* disposed in the nozzle plate 6. FIGS. 4A and 4B are each a projection of the nozzle plate 6 projected onto a plane perpendicular to the central axis 102.

The nozzle holes 7 (7*a* to 7*e*) are disposed to be spaced apart from adjacent nozzle holes at intervals L1 to L4. In FIG. 4A, for example, L1=L2 holds, where L1 and L2 denote distances between the nozzle hole 7*a* and the nozzle holes 7*b* and 7*c* that are adjacent closest to the nozzle hole 7*a*, respectively. At this time, the nozzle hole 7*a* is inclined within a range θa (a third quadrant and a fourth quadrant with reference to the nozzle hole 7*a*) inside the arrangement circle 101 of the nozzle holes.

Quadrants are defined, as shown in FIG. 4B, by a first quadrant, a second quadrant, a third quadrant, and a fourth quadrant that are formed by defining, with reference to the nozzle hole center 105A of the entry 105 of each of the nozzle holes 7, an outer edge side of the nozzle plate 6 as a +y direction and the central axis 102 side of the nozzle plate 6 as a −y direction.

For example, L1<L4 holds, where L1 denotes a distance between the nozzle hole 7*a* that is adjacent closest to the nozzle hole 7*b* and the nozzle hole 7*b*, and L4 denotes a distance between the nozzle hole 7*d* that is adjacent closest to the nozzle hole 7*b* second to the nozzle hole 7*a* and the nozzle hole 7*b*. At this time, the nozzle hole 7*b* is inclined within a range θb of the quadrant (fourth quadrant) inside the arrangement circle 101 of the nozzle holes and on the side of L4 having a longer nozzle-hole-to-nozzle-hole distance.

For example, L2<L3 holds, where L2 denotes a distance between the nozzle hole 7*a* that is adjacent closest to the nozzle hole 7*c* and the nozzle hole 7*c*, and L3 denotes a distance between the nozzle hole 7*e* that is adjacent closest to the nozzle hole 7*c* second to the nozzle hole 7*a* and the nozzle hole 7*c*. At this time, the nozzle hole 7*c* is inclined within a range θc of the quadrant (third quadrant) inside the arrangement circle 101 of the nozzle holes and on the side of L3 having a longer nozzle-hole-to-nozzle-hole distance. In this case, too, the tangent 104 on the third quadrant side is included. In addition, a line segment (y-axis) 107 that connects the center 105A of the entry-side opening 105 of the nozzle hole 7*b* with the central axis 102 is included.

Figure 4C:
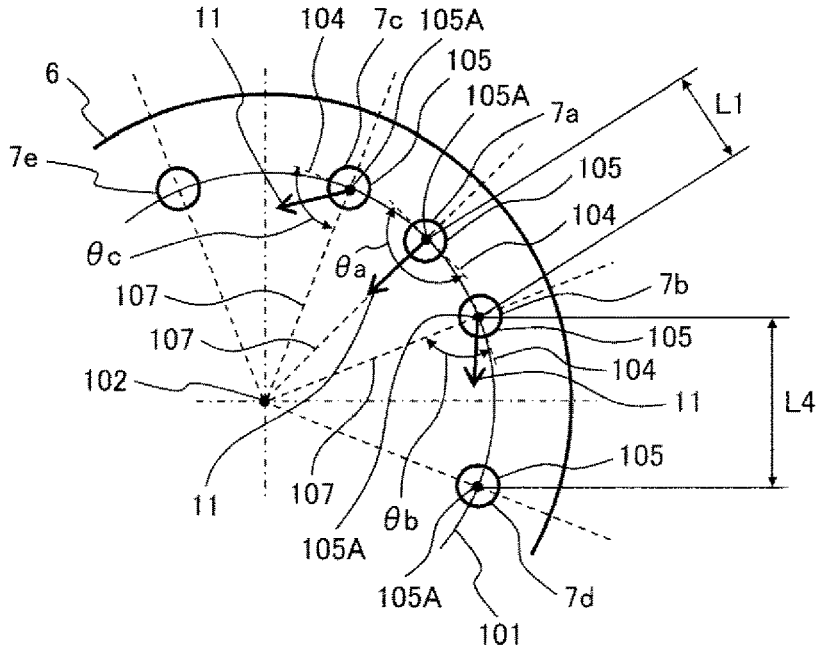
FIG. 4C is an explanatory view illustrating specific examples of inclined nozzle holes according to the first embodiment of the present invention.

Specific examples of directions in which the nozzle holes 7*a*, 7*b*, and 7*c* are inclined will be described with reference to FIG. 4C. FIG. 4C is an explanatory view illustrating specific examples of the inclined nozzle holes according to the first embodiment of the present invention. It is noted that FIG. 4C is a projection of the nozzle plate 6 projected onto a plane perpendicular to the central axis 102. Furthermore, the nozzle holes 7 (7*a* to 7*c*) are disposed in FIG. 4C in the same manner as in FIG. 4A.

The arrows 11 in the Figure indicate respective directions in which the nozzle holes are inclined. In each of the arrows 11, a starting end is disposed at the center 105A of the entry-side opening 105 of the nozzle hole 7 (7*a* to 7*c*) and a terminal end indicates a direction in which the center 106A (see FIG. 3) of the exit-side opening 106 of the nozzle hole 7 is disposed.

The nozzle hole 7*a* is inclined within the range θa in the third and fourth quadrants with reference to the nozzle hole 7*a*. The arrow 11 of the nozzle hole 7*a* has a starting end at the center 105A of the entry-side opening 105 of the nozzle hole 7*a*. The arrow 11 has a terminal end (tip of the arrow) disposed within the range of the third and fourth quadrants. The range of the third and fourth quadrants includes the tangent 104 drawn to extend on both sides of the center 105A of the entry-side opening 105 of the nozzle hole 7*a* and is disposed on the side of the central axis 102 with respect to the tangent 104. Specifically, the center 106A (see FIG. 3) of the exit-side opening 106 of the nozzle hole 7*a* is disposed in a range that includes the tangent 104 and that is disposed on the side of the central axis 102 with respect to the tangent 104.

In the present embodiment, in particular, the nozzle hole 7*a* is inclined toward the central axis 102. In this case, the arrow 11 overlaps the line segment (y-axis) 107 that connects the center 105A of the entry-side opening 105 with the central axis 102.

The nozzle hole 7*b* is inclined within the range θb of the fourth quadrant with reference to the nozzle hole 7*b*. The arrow 11 of the nozzle hole 7*b* has a starting end at the center 105A of the entry-side opening 105 of the nozzle hole 7*b*. The arrow 11 has a terminal end disposed within the range of the fourth quadrant. The range of the fourth quadrant includes the tangent 104 drawn to extend from the side of the fourth quadrant of the center 105A of the entry-side opening 105 of the nozzle hole 7*b* and the line segment (y-axis) 107 that connects the center 105A of the entry-side opening 105 with the central axis 102. Additionally, the range of the fourth quadrant is disposed on the side adjacent to the nozzle hole 7*d* with respect to the line segment 107 (the side opposite to the nozzle hole 7*a*). The center 106A (see FIG. 3) of the exit-side opening 106 of the nozzle hole 7*b* is disposed in this range of the fourth quadrant.

The nozzle hole 7*c* is inclined within the range θc of the third quadrant with reference to the nozzle hole 7*c*. The arrow 11 of the nozzle hole 7*c* has a starting end at the center 105A of the entry-side opening 105 of the nozzle hole 7*c*. The arrow 11 has a terminal end disposed within the range of the third quadrant. The range of the third quadrant includes the tangent 104 drawn to extend from the center 105A of the entry-side opening 105 of the nozzle hole 7*c* to the third quadrant side and the line segment (y-axis) 107 that connects the center 105A of the entry-side opening 105 with the central axis 102. Additionally, the range of the third quadrant is disposed on the side adjacent to the nozzle hole 7*e* with respect to the line segment 107 (the side opposite to the nozzle hole 7*a*). The center 106A (see FIG. 3) of the exit-side opening 106 of the nozzle hole 7*c* is disposed in this range of the third quadrant.

Figure 5:
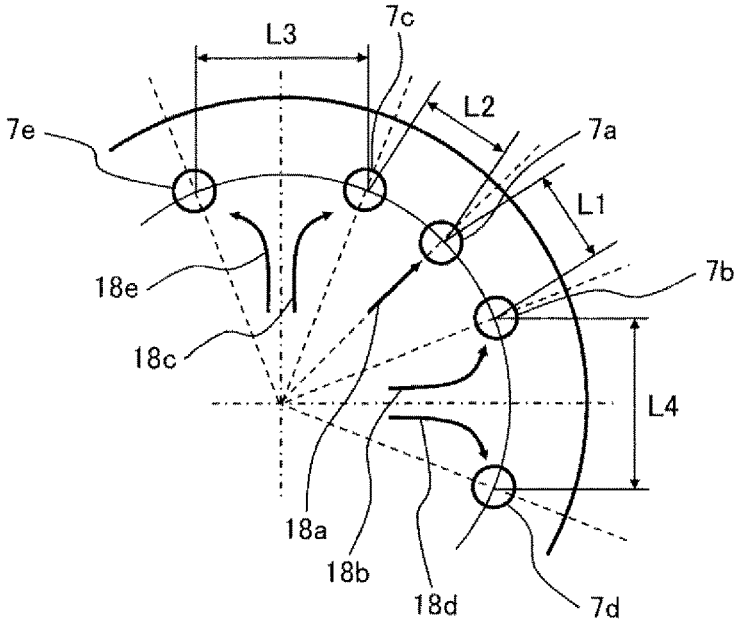
FIG. 5 is a view illustrating a fuel flow field within the nozzle plate according to the first embodiment of the present invention.
Figure 6:
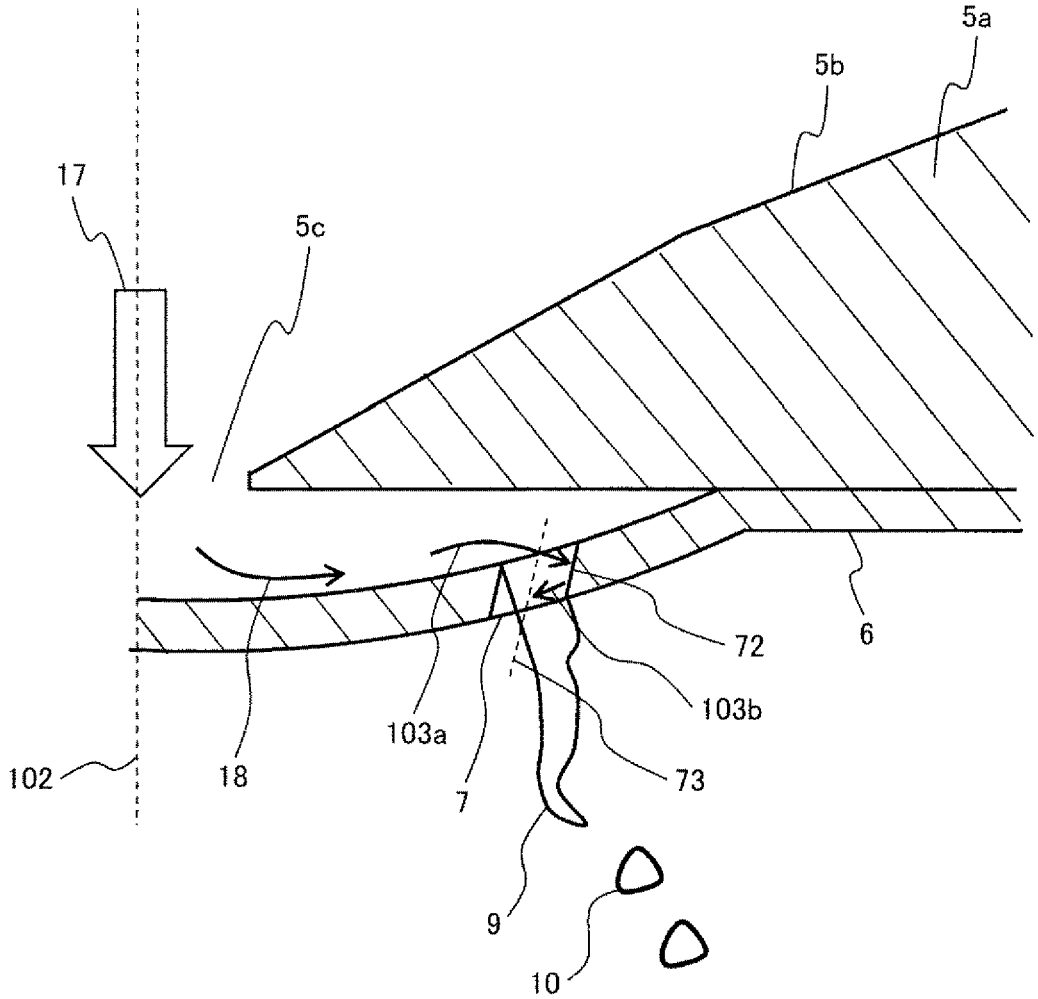
FIG. 6 is an explanatory view illustrating a mechanism involved in fuel atomization in the present invention.

Reasons for establishing the direction in which the nozzle hole is inclined using the nozzle-hole-to-nozzle-hole distances as described above will be described with reference to FIGS. 5 and 6. FIG. 5 is a view illustrating a fuel flow field within the nozzle plate according to the first embodiment of the present invention. FIG. 6 is an explanatory view illustrating a mechanism involved in fuel atomization in the present invention. It is noted that FIG. 5 is a projection of the nozzle plate 6 projected onto a plane perpendicular to the central axis 102.

In FIG. 5, the arrows indicate fuel flow directions 18*a*, 18*b*, 18*c*, 18*d*, and 18*e* that assume main flows with respect to the nozzle holes 7*a*, 7*b*, 7*c*, 7*d*, and 7*e*, respectively, inside the nozzle plate (in the fuel chamber 6B). A greater amount of fuel flows to the ranges of L3 and L4 that involve longer nozzle-hole-to-nozzle-hole distances. Thus, the fuel main flows 18*b* and 18*c* with respect to the nozzle holes 7*b* and 7*c* flow in obliquely from the L3 and L4 sides, as against radial directions extending from the central axis 102 of the nozzle plate 6 toward the centers of the respective nozzle holes. Meanwhile, with the nozzle hole 7*a*, the fuel flow 18*a* flowing uniformly in the radial direction is the main flow because of the nozzle-hole-to-nozzle-hole distances involved of L1=L2.

FIG. 6 is an enlarged view (cross-sectional view) of parts near the nozzle hole 7. As shown in the Figure, the fuel flow 17 at the opening 5*c* in the fuel passage portion collides with the upper surface of the nozzle plate 6 to become a fast flow 18 flowing in the main flow direction along the wall surface of the nozzle plate 6. If the nozzle hole 7 is inclined in a direction opposed to the main flow direction, a fuel 103*a* flowing in the nozzle hole 7 collides with a wall surface 72 of the nozzle hole and a flow 103*b* having a large velocity component is induced in a plane perpendicular to a central axis 73 of the nozzle hole 7. As a result, when the fuel forms the liquid film 9 under the nozzle hole, the liquid film 9 tends to be fragmented into the liquid droplets 10, so that atomization is promoted. Furthermore, in the present embodiment, the nozzle hole 7 is inclined, from the nozzle hole entry to the nozzle hole exit, toward the fuel main flow direction 18, specifically, toward the central axis 102 of the nozzle plate 6. This arrangement can prevent the spray from spreading to the outer edge side of the nozzle plate 6, so that the spray angle can be made small.

To incline the nozzle hole 7 in the direction opposed to the main flow direction, preferably, the nozzle hole 7*a* is inclined on the inside of the arrangement circle 101 and within the range θa in the third and fourth quadrants not including the tangent 104. Specifically, preferably, the nozzle hole 7*a* is disposed such that, in FIG. 4C, the center 106A of the exit-side opening 106 is disposed inside the arrangement circle 101. More preferably, the nozzle hole 7*a* is inclined such that the arrow 11 overlaps the line segment 107 in FIG. 4C.

Additionally, preferably, the nozzle hole 7*b* is inclined on the inside of the arrangement circle 101 and within the range θb in the fourth quadrant not including the tangent 104 or the line segment 107. Specifically, preferably, the nozzle hole 7*b* is inclined such that, in FIG. 4C, the center 106A of the exit-side opening 106 is disposed inside the arrangement circle 101 and in the range on the side of the nozzle hole 7*d* with respect to the line segment 107 (on the side opposite to the nozzle hole 7*a*).

Additionally, preferably, the nozzle hole 7*c* is inclined on the inside of the arrangement circle 101 and within the range θc in the third quadrant not including the tangent 104 or the line segment 107. Specifically, preferably, the nozzle hole 7*c* is inclined such that, in FIG. 4C, the center 106A of the exit-side opening 106 is disposed inside the arrangement circle 101 and in the range on the side of the nozzle hole 7*e* with respect to the line segment 107 (on the side opposite to the nozzle hole 7*a*).

Figure 7:
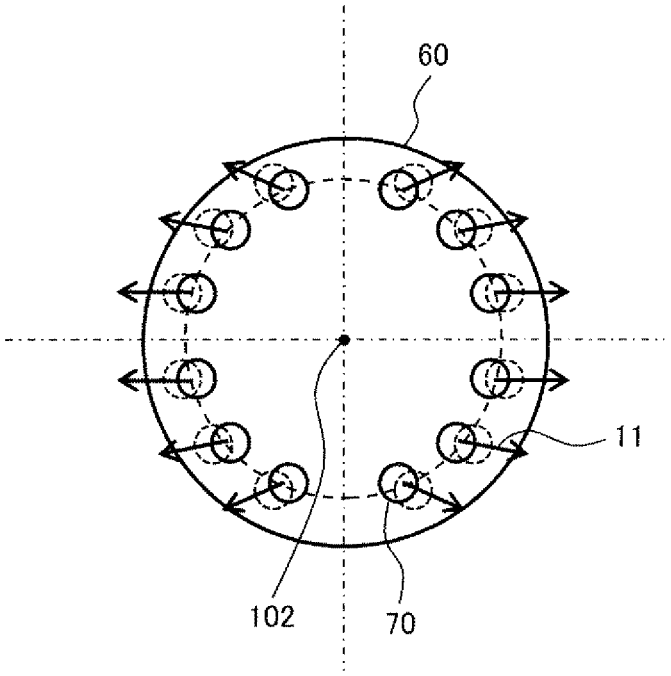
FIG. 7 is a view of a nozzle plate in a fuel injection valve according to a comparative example of the present invention, as viewed from a valve element side.
Figure 8:
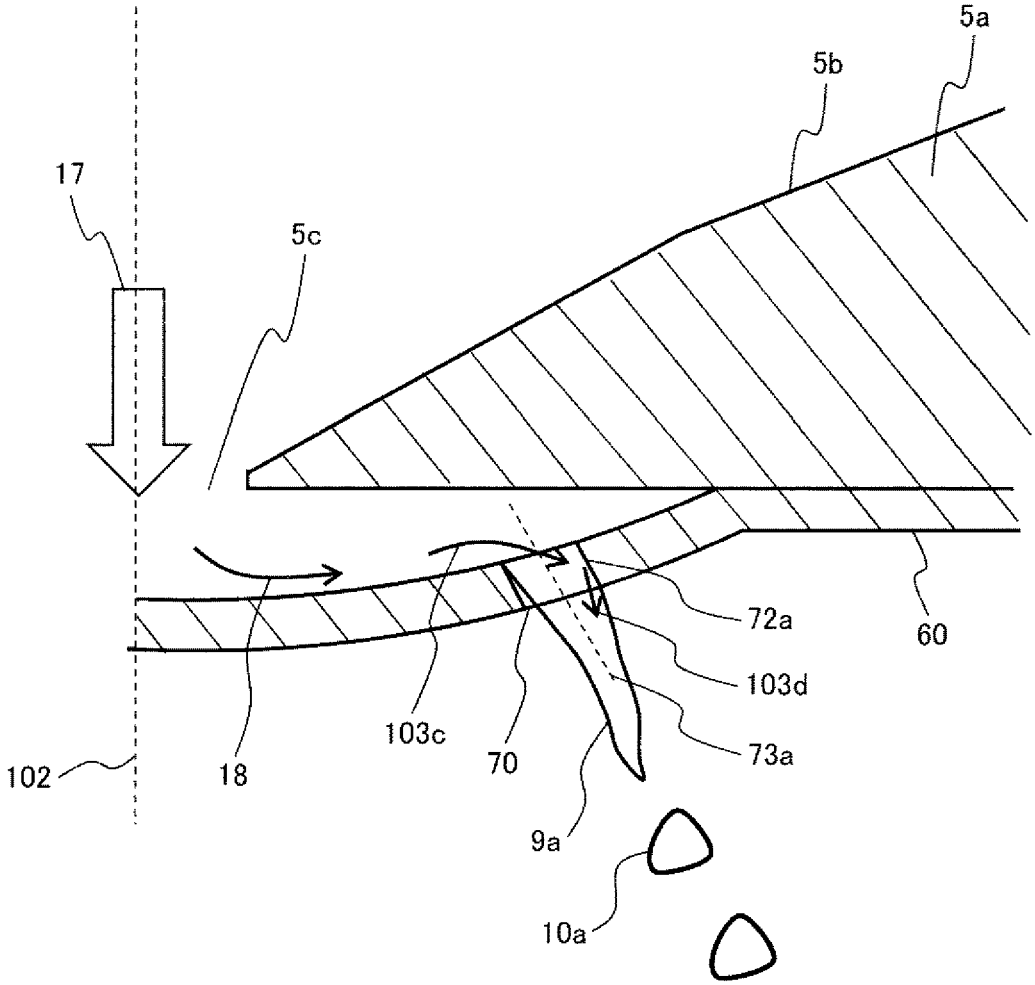
FIG. 8 is an explanatory view illustrating a flow field near a nozzle hole in the fuel injection valve according to the comparative example of the present invention.

As a comparative example of the present invention, a configuration in which the nozzle holes have downstream ends inclined outwardly will be compared. FIG. 7 is a view of a nozzle plate in a fuel injection valve according to a comparative example of the present invention, as viewed from a valve element side. FIG. 8 is an explanatory view illustrating a flow field near a nozzle hole in the fuel injection valve according to the comparative example of the present invention.

Nozzle holes 70 are inclined from nozzle hole entries toward nozzle hole exits in a direction in which the nozzle holes 70 are spaced apart from a central axis 102 of a nozzle plate 60 in order to avoid interference of sprays. In this case, as shown in FIG. 8, the nozzle hole 70 is not optimally inclined with respect to a main flow direction 18. This results in weak collision force of a fuel flow 103*d* flowing in the nozzle hole 70 on a nozzle hole wall surface. As a result, a velocity component in a direction in a plane perpendicular to a central axis 73*a* of the nozzle hole 70 becomes small, so that a velocity component toward the central axis 73*a* becomes large in the nozzle hole 70 as with the flow 103*d*. Thus, a velocity component in a radial direction is small in the nozzle hole 70 and the fuel does not tend to spread in an area downstream of the nozzle hole 70. The foregoing results in a larger particle diameter of the fuel spray, aggravating atomization performance. Thus, in the present embodiment, the fuel main flow direction is defined using the nozzle-hole-to-nozzle-hole distance and optimum inclination ranges of the nozzle holes are defined to correspond to the nozzle-hole-to-nozzle-hole distance. The configurations described in the present embodiment can narrow the spray angle and promote atomization.

Second Embodiment

Figure 9:
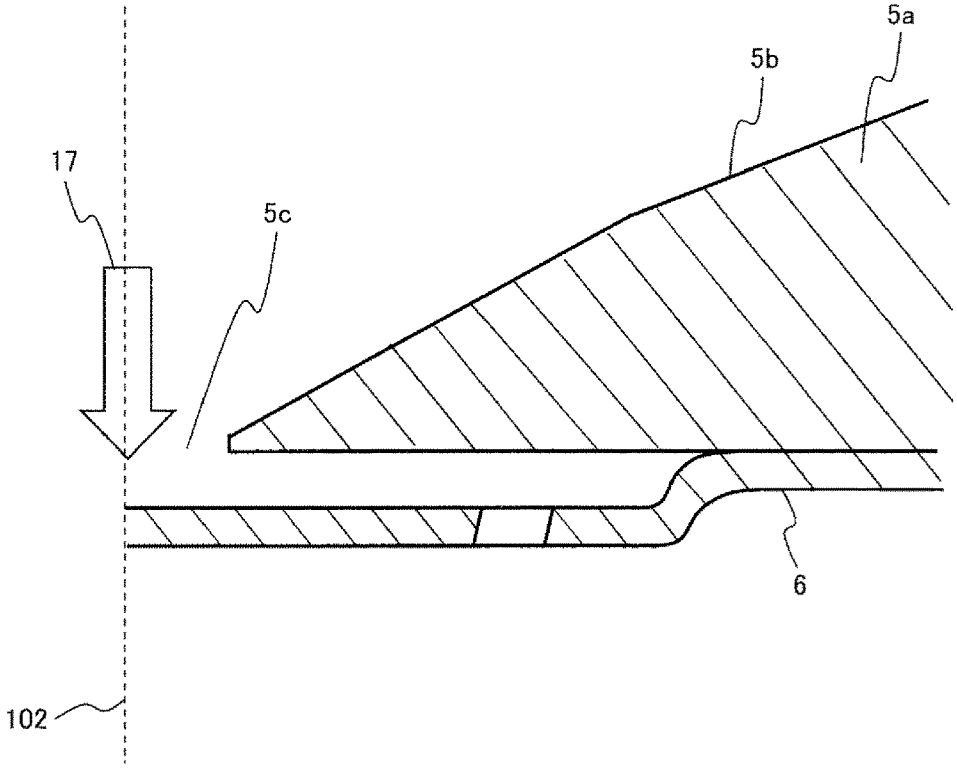
FIG. 9 is an enlarged cross-sectional view of parts near a nozzle hole of a fuel injection valve according to a second embodiment of the present invention.

A fuel injection valve according to a second embodiment of the present invention will be described below with reference to FIG. 9. FIG. 9 is an enlarged cross-sectional view of parts near a nozzle hole of the fuel injection valve according to the second embodiment of the present invention. Parts to which like reference numerals as those used in the description of the first embodiment are assigned have like or equivalent functions as those described in the first embodiment and descriptions therefor will be omitted.

FIG. 9 shows a nozzle plate 6 that is formed into a planar shape, instead of a curved surface shape as shown in FIG. 2 for the first embodiment. The present embodiment can achieve the same effects as those described with reference to the first embodiment.

Third Embodiment

Figure 10:
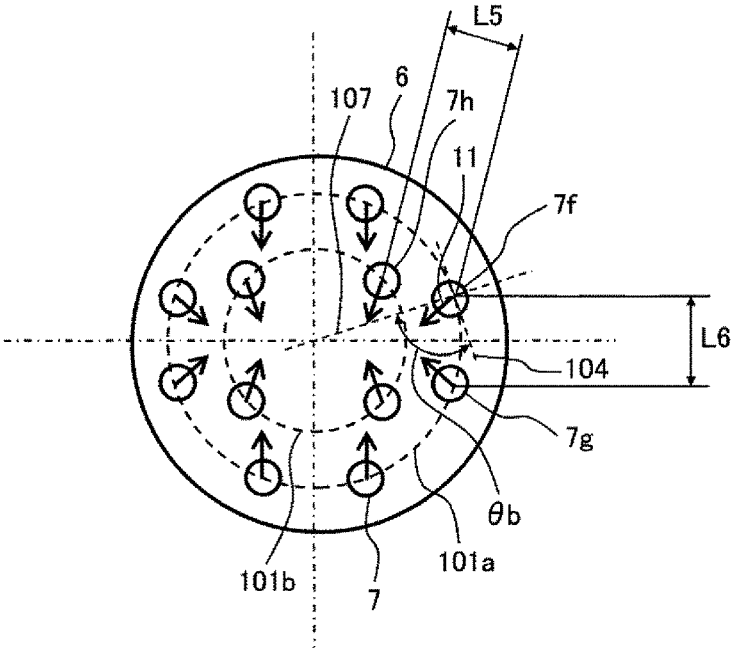
FIG. 10 is a view of a nozzle plate in a fuel injection valve according to a third embodiment of the present invention, as viewed from a valve element side.

A fuel injection valve according to a third embodiment of the present invention will be described below with reference to FIG. 10. FIG. 10 is a view of a nozzle plate in the fuel injection valve according to the third embodiment of the present invention, as viewed from a valve element side. Parts to which like reference numerals as those used in the description of the first embodiment are assigned have like or equivalent functions as those described in the first embodiment and descriptions therefor will be omitted.

In the present embodiment, a variation in nozzle hole arrangements will be described.

In a nozzle plate 6 shown in FIG. 10, a plurality of nozzle holes are disposed on two arrangement circles 101*a* and 101*b*. Inclination directions 11 of nozzle holes 7 are established as in the first embodiment for the nozzle holes 7 disposed on the two arrangement circles 101*a* and 101*b*. Specifically, the inclination direction 11 of a specific nozzle hole is established on the basis of quadrants of the specific nozzle hole (see FIG. 4B) using a distance between the specific nozzle hole and a nozzle hole closest thereto. The same effects achieved by the first embodiment can thereby be achieved.

In FIG. 10, the inclination direction of a nozzle hole 7*f*, for example, is established on the basis of a nozzle-hole-to-nozzle-hole distance involving a nozzle hole 7*h* disposed on the arrangement circle 101*a* and the nozzle hole 7*f* and a nozzle hole 7*g* disposed on the arrangement circle 101*b*. A relation of L6>L5 holds, where L6 denotes a distance between the nozzle hole 7*f* and the nozzle hole 7*g* and L5 denotes a distance between the nozzle hole 7*f* and the nozzle hole 7*h*.

In this case, the nozzle hole 7*f* is inclined within the range θb in the fourth quadrant with reference to the nozzle hole 7*f* as with the nozzle hole 7*b* described with reference to the first embodiment.

Fourth Embodiment

Figure 11:
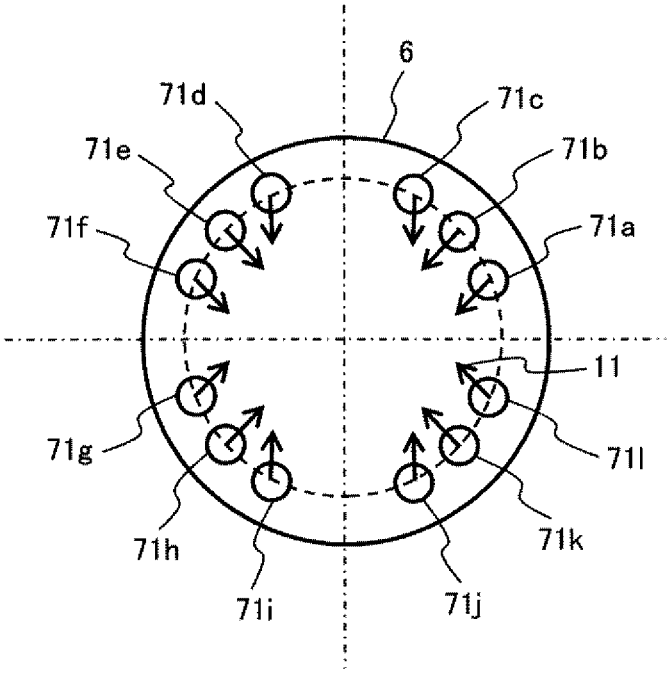
FIG. 11 is a view of a nozzle plate in a fuel injection valve according to a fourth embodiment of the present invention, as viewed from a valve element side.

A fuel injection valve according to a fourth embodiment of the present invention will be described below with reference to FIG. 11. FIG. 11 is a view of a nozzle plate in the fuel injection valve according to the fourth embodiment of the present invention, as viewed from a valve element side. The present embodiment will be described for an effect that can be achieved by applying the nozzle hole inclination described with reference to the first embodiment to only part of the nozzle holes. Parts to which like reference numerals as those used in the description of the first embodiment are assigned have like or equivalent functions as those described in the first embodiment and descriptions therefor will be omitted.

The fuel injection valve in the present embodiment includes a nozzle plate 6 that has a plurality of nozzle holes 71 (71*a* to 71*l*). In the present embodiment, to achieve a target spray shape through adjustments of the spray shape, the nozzle holes 71*c*, 71*d*, 71*i*, and 71*j* representing part of the whole nozzle holes 71 are inclined in directions different from the optimum inclination directions described with reference to the first embodiment.

In FIG. 11, the nozzle holes 71*a*, 71*b*, 71*e*, 71*f*, 71*g*, 71*h*, 71*k*, and 71*l* are inclined in the directions described with reference to the first embodiment. The nozzle holes 71*c* and 71*i* are set to have an inclination direction within the fourth quadrant in order to achieve the target spray shape, although the optimum inclination direction thereof is within the third quadrant for atomization. Additionally, the nozzle holes 71*d* and 71*j* are set to have an inclination direction within the third quadrant in order to achieve the target spray shape, although the optimum inclination direction thereof is within the fourth quadrant for atomization.

As such, all nozzle holes are not necessarily required to have the inclination directions as described with reference to the first embodiment. For example, an arrangement in which only the nozzle holes 71*a*, 71*b*, 71*e*, 71*f*, 71*g*, 71*h*, 71*k*, and 71*l* representing part of the whole nozzle holes 71 are set to have the inclination directions described with reference to the first embodiment can achieve the same effect as that described with reference to the first embodiment in the nozzle holes 71*a*, 71*b*, 71*e*, 71*f*, 71*g*, 71*h*, 71*k*, and 71*l* representing part of the whole nozzle holes 71.

Features of the present invention derived from each of the above-described embodiments will be described below.

(A) The fuel injection valve in the embodiments of the present invention includes: the seat member 15*a* having the valve seat 15*b*; the valve element 3 that seats on the valve seat 15*b* to be closed and leaves the valve seat 15*b* to be open; the fuel passage portion 5*c* disposed downstream of the valve seat 15*b*; the fuel diffusion chamber 6B disposed downstream of the fuel passage portion 5*c*; and a plurality of nozzle holes 7, 71 through which fuel in the fuel diffusion chamber 6B is injected to an outside. The fuel injection valve causes fuel that has flowed from the fuel passage portion 5*c* into the fuel diffusion chamber 6B to be diffused from a central side of the fuel diffusion chamber 6B toward an outer peripheral side to thereby flow into the nozzle holes 7, 71. In this fuel injection valve, the nozzle holes 7, 71 include the first nozzle hole 7*b*, 7*f*, 71*a*, and the second nozzle hole 7*d*, 7*g*, 71*l* and the third nozzle hole 7*a*, 7*h*, 71*h* disposed to be spaced apart from the first nozzle hole 7*b*, 7*f*, 71*a* at least in a circumferential direction of the fuel diffusion chamber 6B, the second nozzle hole 7*d*, 7*g*, 71*l* and the third nozzle hole 7*a*, 7*h*, 71*h* being adjacent in the circumferential direction to the first nozzle hole 7*b*, 7*f*, 71*a*. When the distance L4, L6 between the center 105A of the entry-side opening 105 of the first nozzle hole 7*b*, 7*f*, 71*a* and the center 105A of the entry-side opening 105 of the second nozzle hole 7*d*, 7*g*, 71*l* is greater than the distance L1, L5 between the center 105A of the entry-side opening 105 of the first nozzle hole 7*b*, 7*f*, 71*a* and the center 105A of the entry-side opening 105 of the third nozzle hole 7*a*, 7*h*, 71*h*, the first nozzle hole 7*b*, 7*f*, 71*a* has an inclination direction set such that the exit-side opening 106 is disposed within a range θa including the tangent 104 extending tangentially to the arrangement circle 101, 101*a*, 101*b* that is drawn about the center 102 of the fuel diffusion chamber 6B and that passes through the center 105A of the entry-side opening 105, the range θa being disposed on the side of the center 102 of the fuel diffusion chamber 6B with respect to the tangent 104, and a range θb including the line segment 107 that passes through the center 102 of the fuel diffusion chamber 6B and the center 105A of the entry-side opening 105 and that is disposed on the side of the second nozzle hole 7*d*, 7*g*, 71*l* with respect to the line segment 107.

(B) In the fuel injection valve of (A), preferably, the center 106A of the exit-side opening 106 of the first nozzle hole 7*b*, 7*f*, 71*a* is disposed inside the arrangement circle 101, 101*a*, 101*b* and on the side of the second nozzle hole 7*d*, 7*g*, 71*l* with respect to the line segment 107.

(C) In the fuel injection valve of (B) above, preferably, the nozzle holes further include the fourth nozzle hole 7*c*, 71*c* disposed in the circumferential direction on the side opposite to the first nozzle hole 7*b*, 71*a* with respect to the third nozzle hole 7*a*, 71*h*, and when the distance L2 between the center 105A of the entry-side opening 105 of the third nozzle hole 7*a*, 71*h* and the center 105A of the entry-side opening 105 of the fourth nozzle hole 7*c*, 71*c* is equal to the distance L1 between the center 105A of the entry-side opening 105 of the third nozzle hole 7*a*, 71*h* and the center 105A of the entry-side opening 105 of the first nozzle hole 7*b*, 71*a*, preferably, the third nozzle hole 7*a*, 71*h* has an inclination direction set such that the exit-side opening 106 is disposed within a range including the tangent 104 extending tangentially to the arrangement circle 101 that is drawn about the center 102 of the fuel diffusion chamber 6B and that passes through the center 105A of the entry-side opening 105, the range being disposed on the side of the center 102 of the fuel diffusion chamber 6B with respect to the tangent 104.

(D) In the fuel injection valve of (C) above, preferably, the center 106A of the exit-side opening 106 of the third nozzle hole 7*a*, 71*h* is disposed inside the arrangement circle 101.

(E) In each of the fuel injection valve of (A) to (D), preferably, at least one nozzle hole 7*f*, 7*g* out of the first nozzle hole 7*f* and the second nozzle hole 7*g*, and the third nozzle hole 7*h* is disposed on the arrangement circle 101*a* different from the arrangement circle 101*b* on which the other nozzle hole 7*h* is disposed.

It should be noted that the present invention is not limited to the above-described embodiments and may include various modifications. For example, the entire detailed arrangement of the embodiments described above for ease of understanding of the present invention is not always necessary to embody the present invention. Additionally, part of the arrangement of one embodiment may be replaced with the arrangement of another embodiment, or the arrangement of one embodiment may be combined with the arrangement of another embodiment. Furthermore, the arrangement of each embodiment may additionally include another arrangement, or part of the arrangement may be deleted or replaced with another.

REFERENCE SIGNS LIST

1 fuel injection valve
2 casing
2*a* fuel supply port
3 valve element
4 anchor
5 nozzle body
5*a* seat member
5*b* valve seat surface
5*c* opening
6 nozzle plate
6A projecting surface (curved surface portion)
6B fuel chamber (fuel diffusion chamber)
7, 7*a*, 7*b*, 7*c*, 7*d*, 7*e*, 7*f*, 7*g*, 7*h* nozzle hole
8 distribution of velocity of fuel colliding with nozzle plate upper surface
9, 9*a* fuel liquid film
10, 10*a* liquid droplet
11 fuel injection hole inclination direction
12 spring
13 spring adjuster
14 electromagnetic coil
15 core
16 yoke
17 fuel flow in opening of fuel passage portion disposed downstream of valve element
18, 18*a*, 18*b*, 18*c* fuel main flow in areas on nozzle plate
20 filter
21 O-ring
22 resin cover
23 connector
24 protector
25 O-ring
60 nozzle plate of comparative example
70 nozzle hole in nozzle plate of comparative example
71*a*, 71*b*, 71*c*, 71*d*, 71*e*, 71*f*, 71*g*, 71*h*, 71*i*, 71*j*, 71*k* nozzle hole
72, 72*a* surface in nozzle hole with which flow collides
73, 73*a* central axis of nozzle hole
101, 101*a*, 101*b* nozzle hole arrangement circle
102 central axis of nozzle plate
103*a*, 103*b*, 103*c*, 103*d* flow near and in nozzle hole
104 tangent to arrangement circle
105 entry-side opening of nozzle hole
105A center of entry-side opening of nozzle hole
106 exit-side opening of nozzle hole
106A center of exit-side opening of nozzle hole
107 line segment connecting center of entry-side opening of nozzle hole with central axis of nozzle plate

The invention claimed is:

1. A fuel injection valve, comprising:

a seat member having a valve seat;

a valve element that seats on the valve seat to be closed and leaves the valve seat to be open;

a fuel passage portion disposed downstream of the valve seat;

a fuel diffusion chamber disposed downstream of the fuel passage portion; and nozzle holes through which fuel in the fuel diffusion chamber is injected to an outside, the fuel injection valve causing fuel that has flowed from the fuel passage portion into the fuel diffusion chamber to be diffused from a central side toward an outer peripheral side to thereafter flow into the nozzle holes, wherein the nozzle holes include a first nozzle hole, and second and third nozzle holes disposed to be spaced apart from the first nozzle hole at least in a circumferential direction of the fuel diffusion chamber, the second and third nozzle holes being adjacent in the circumferential direction to the first nozzle hole, and when a distance between a center of an entry-side opening of the first nozzle hole and a center of an entry-side opening of the second nozzle hole is greater than a distance between the center of the entry-side opening of the first nozzle hole and a center of an entry-side opening of the third nozzle hole, the first nozzle hole has an inclination direction set such that an exit-side opening is disposed within a range including a tangent extending tangentially to an arrangement circle that is drawn about a center of the fuel diffusion chamber and that passes through the center of the entry-side opening, the range being disposed on a side of the center of the fuel diffusion chamber with respect to the tangent, and the range including a line segment that passes through the center of the fuel diffusion chamber and the center of the first nozzle hole and that is disposed on a side of the second nozzle hole with respect to the line segment, the center of the exit-side opening of the first nozzle hole is disposed inside the arrangement circle and on a side of the second nozzle hole with respect to the line segment, the nozzle holes further include a fourth nozzle hole disposed in the circumferential direction on a side opposite to the first nozzle hole with respect to the third nozzle hole, and when a distance between a center of an entry-side opening of the third nozzle hole and a center of an entry-side opening of the fourth nozzle hole is equal to a distance between the center of the entry-side opening of the third nozzle hole and the center of the entry-side opening of the first nozzle hole, the third nozzle hole has an inclination direction set such that the third nozzle hole is disposed within a range including a tangent extending tangentially to the arrangement circle that is drawn about the center of the fuel diffusion chamber and that passes through the center of the entry-side opening, the range being disposed on a side of the center of the fuel diffusion chamber with respect to the tangent.

2. The fuel injection valve according to claim 1, wherein the center of the exit-side opening of the third nozzle hole is disposed inside the arrangement circle.

* * * * *